United States Patent [19]

Tschudy et al.

[11] 4,405,346

[45] Sep. 20, 1983

[54] CLEANER WITH DIRT CUP

[75] Inventors: Donald B. Tschudy; Emmett D. Lorson, both of Canton, Ohio

[73] Assignee: The Hoover Company, North Canton, Ohio

[21] Appl. No.: 282,443

[22] Filed: Jul. 13, 1981

[30] Foreign Application Priority Data

May 13, 1981 [GB] United Kingdom ..... 8114567

[51] Int. Cl.[3] ..... B01D 46/48

[52] U.S. Cl. ..... 55/357; 15/351; 15/352; 55/366; 55/376; 55/378; 55/429; 55/507; 55/509; 55/DIG. 3

[58] Field of Search ..... 55/357, 366, 374–378, 55/429, 507, 509, DIG. 3; 15/348, 351, 350, 352; 248/100, 101, 99

[56] References Cited

U.S. PATENT DOCUMENTS

| | | | |
|---|---|---|---|
| 1,208,994 | 12/1916 | Lion | 55/379 |
| 1,234,095 | 7/1917 | Duffie | 15/351 |
| 1,742,564 | 1/1930 | Summers | 55/429 X |
| 1,929,025 | 10/1933 | Leathers | 55/357 X |
| 1,937,766 | 12/1933 | Leathers | 55/366 |
| 2,046,172 | 6/1936 | Leathers | 15/350 |
| 2,130,513 | 9/1938 | Smellie | 55/357 |
| 2,187,164 | 1/1940 | Leathers | 55/366 X |
| 2,210,724 | 8/1940 | Leathers | 55/366 X |
| 2,406,278 | 8/1946 | Worth | 55/429 X |
| 2,463,435 | 3/1949 | Smellie | 55/509 X |
| 2,542,634 | 2/1951 | Davis et al. | 55/429 X |
| 2,714,426 | 8/1955 | White | 55/366 X |
| 2,823,411 | 2/1958 | Kirby | 55/366 X |
| 3,199,138 | 8/1965 | Nordeen | 15/350 |
| 4,073,632 | 2/1978 | Reinauer et al. | 55/374 |

FOREIGN PATENT DOCUMENTS

| | | | |
|---|---|---|---|
| 421058 | 6/1969 | Australia | 55/378 |
| 117957 | 8/1918 | United Kingdom | 55/378 |

*Primary Examiner*—Kathleen J. Prunner
*Attorney, Agent, or Firm*—Gerald H. Kreske; Richardson B. Farley

[57] ABSTRACT

A vacuum cleaner is provided with a dirt cup and a dirt cup holder that telescopically engages with a handle of the cleaner for the guidance of it as the handle of the cleaner pivots relative to the main body of the cleaner.

7 Claims, 9 Drawing Figures

CLEANER WITH DIRT CUP

BACKGROUND OF THE INVENTION

1. Field of the Invention

This invention relates to a vacuum cleaner and, more specifically, relates to a cleaner in which the dirt cup and its holder move relative to the cleaner handle.

2. Description of the Prior Art

Although vacuum cleaners are known having a dirt container which is mounted through ancilliary structure to move relative to a cleaner handle; none are known which use a telescopic engagement between the cleaner handle and the actual dirt cup holder for an extremely positive guidance arrangement. Further, no dirt cup arrangement is known having the improved dirt cup latching structure, bag retention means, dirt tube mounting or universal holder handle mounting means of the instant invention.

Accordingly, it is an object of this invention to mount the dirt cup holder telescopically over the handle to provide positive guiding of the two relative to each other.

It is an additional object of the invention to include a latch structure easily mounted to the holder and having positive engagement with the dirt cup.

It is a further object of the invention to provide an improved bag retention means at the dirt cup holder interface.

It is still a further object of the invention to utilize the dirt cup holder to effectively mount the dirt tube.

It is an additional object of the invention to provide a mating jointure between the handle and dirt cup which accommodates a variety of handle shapes.

It is still further object of the invention to provide an improved dirt cup and dirt cup holder configuration.

SUMMARY OF THE INVENTION

This invention relates to cleaners having dirt cups also known as dirt cup cleaners having a dirt cup reception means for the dirt picked up from a rug or the like during the cleaning operation. The present invention has as its principal object the provision of a new dirt cup cleaner mounting arrangement which materially aids in the use of a dirt cup configuration with a cleaner with which it is associated.

According to the present invention, a suction cleaner includes a dirt cup reception means for dirt picked up in the cleaner during the cleaning operation. The dirt cup is mounted with a mounting structure that telescopes over the handle of the cleaner so that the relative motion between the handle and the dirt cup during its pivoting action is easily accommodated. The dirt cup holder includes a tubular reception means for an upper fill tube that extends from the cleaner so as to discharge dirt in a bag situated above the dirt cup. The dirt cup holder also includes a hoop configuration and which provides at its bottom side a seating means for the dirt cup and at its upper side a series of hook-like projections which receive a filter bag expander of generally the same configuration and also having hook means.

The pervious, filter bag, disposed above the dirt cup, includes at its bottom border a reinforcement member around which the bottom of the filter bag is wrapped and sewn, providing a thickened portion so that the same may be compressingly fixed between the filter bag expander and the hoop portion on the dirt cup support. The bag extends upwardly from this arrangement so as to be rigidly hung from the handle of the cleaner through the use of clevis and a hook, these elements being generally conventional in the cleaner art.

The dirt cup support includes outwardly of the upper fill duct an extension piece that extends down and is relieved to receive a rivet on each side which connects an offset portion on the upper fill duct near its lower reaches to mount the upper fill duct with the dirt cup holder. Below this connection, the upper fill duct is attached to a bellows which extends to the motor fan system (not shown) contained in the bottom portion of the cleaner.

The dirt cup seats in the hoop portion of the dirt cup support and extends downwardly therefrom to be latched to the dirt cup support by means of a pair of latches. These latches are resilient so that the same tend to urge the dirt cup upwardly against its seating and are bendable slightly so as to pivot into receptive relationship with the dirt cup at its bottom portions. The latches at their upper ends are received within the hoop portion of the dirt cup support, and, between it and the bag reinforcement and bag extending downwardly from its rigid connection.

DESCRIPTION OF THE DRAWINGS

Reference may now be had to the accompanying Drawings for a better understanding of the invention, both as to its organization and function, with the illustration being only exemplary, and in which.

DETAILED DESCRIPTION OF PREFERRED EMBODIMENT

Figures 1, 4:
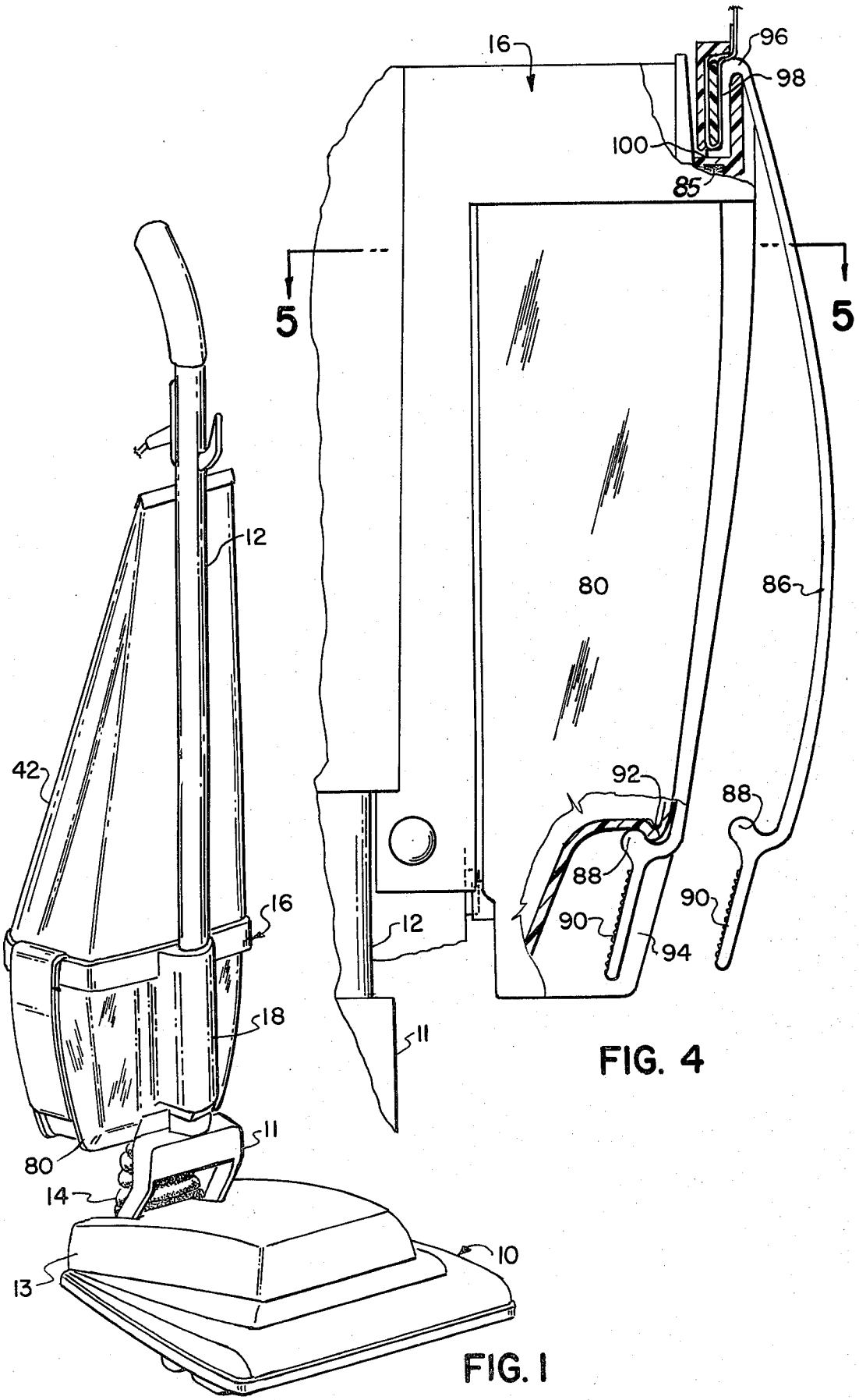
FIG. 1 is a perspective elevational view of a cleaner incorporating the invention.
FIG. 4 is a partial cross sectional elevational view of the dirt cup and dirt cup support.

A cleaner 10 includes a yoke 11, a handle 12, and a bellows 14 connected to a main body 13, that houses the motor fan system (not shown) which provides a flow of cleaner dust laden air up to the bellows 14. The handle 12, as is conventional, is pivoted through the yoke 11 to the cleaner main body 13 so that the same extends upwardly therefrom to provide a convenient grasping means for the user of the cleaner 10.

Figure 2:
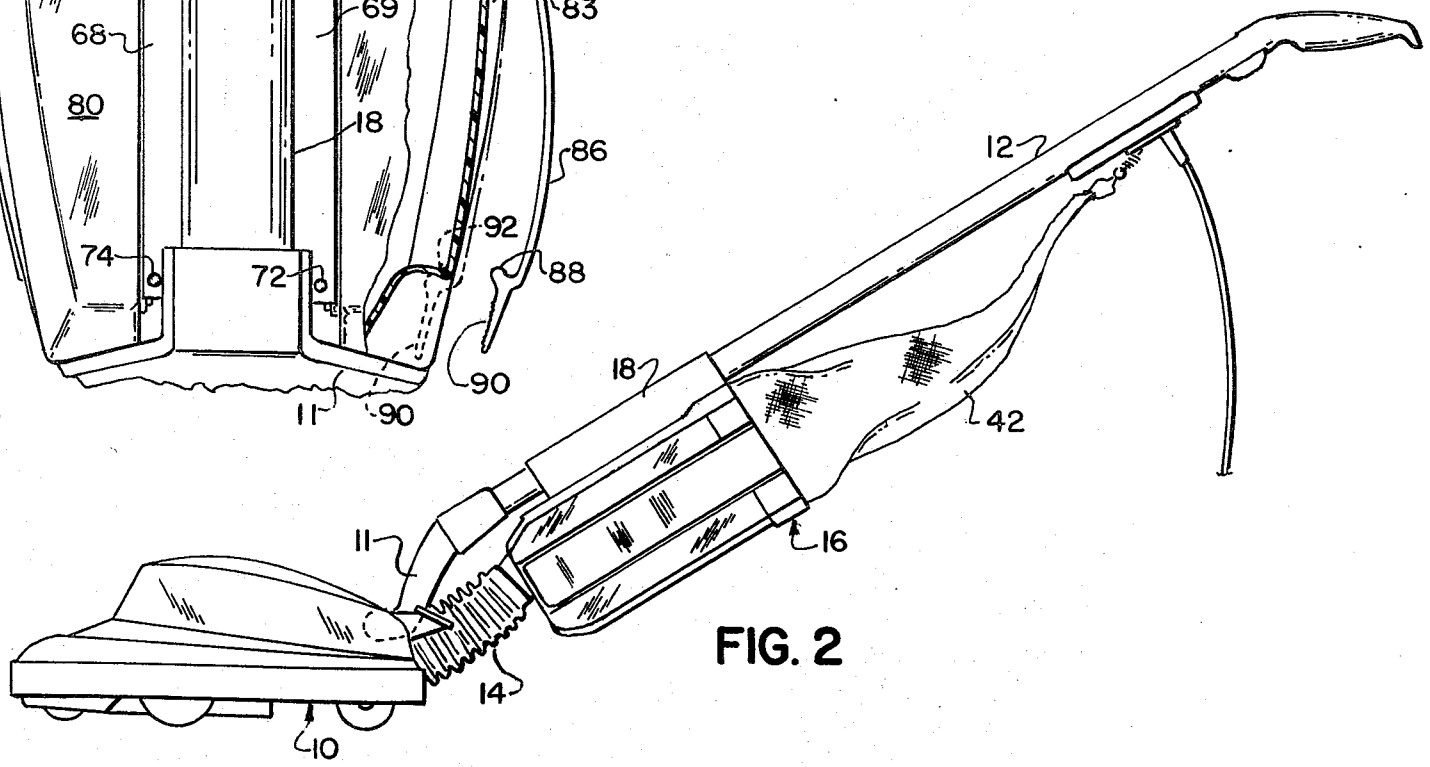
FIG. 2 is a side elevational view of a cleaner incorporating the dirt cup arrangement showing the position of it with the cleaner handle pivoted downwardly.
Figure 6:
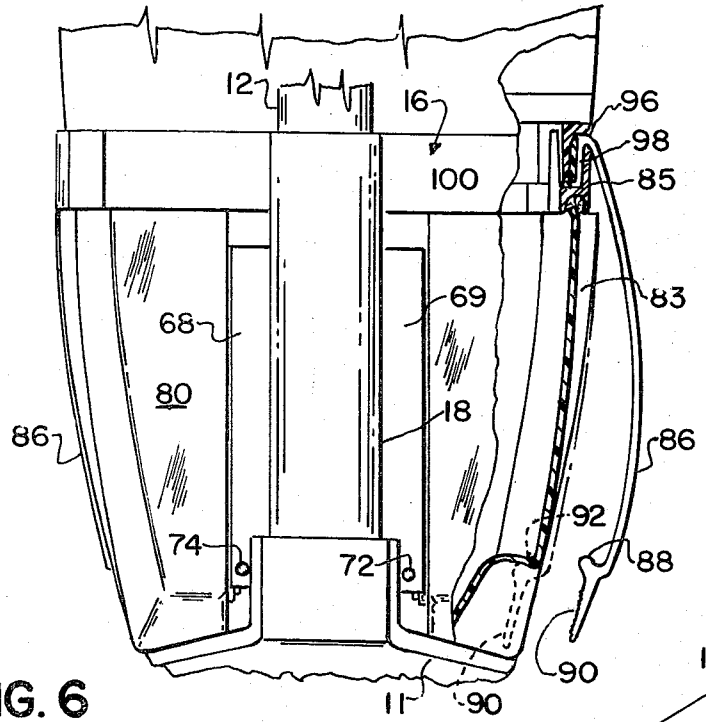
FIG. 6 is an elevational view of the dirt cup, dirt cup holder latch arrangement and filter bag rigid connection looking from the handle side of the cleaner and taken generally on line 6—6 of FIG. 3.
Figure 3:
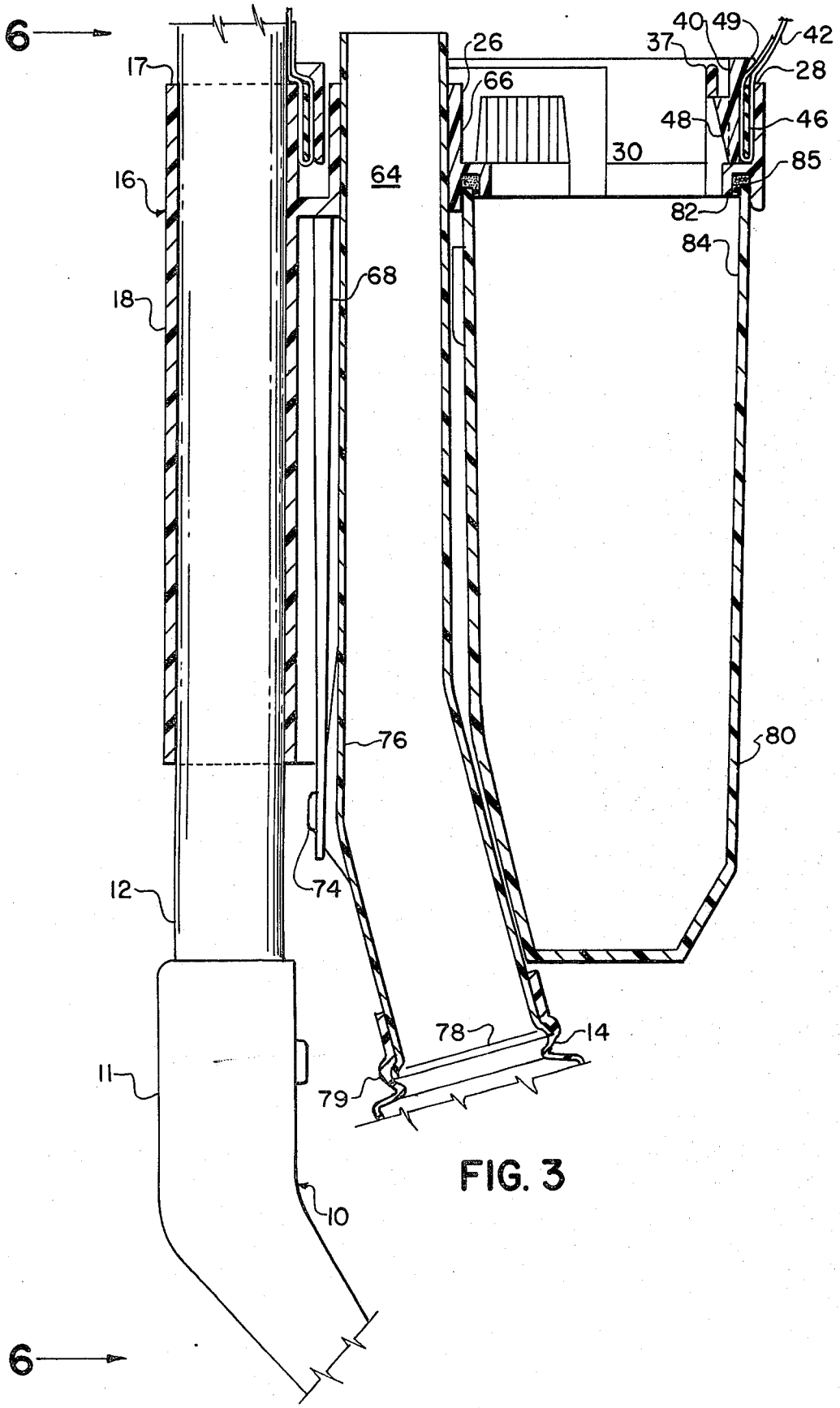
FIG. 3 is a partial cross sectional elevational view of the dirt cup holder and handle configuration of the dirt cup cleaner with the handle pivoted downwardly and taken on line 3—3 of FIG. 7.

Mounted on the handle 12 is a dirt cup support 16 which includes a sidewardly, laterally extending portion 17 and an integral tubular depending portion 18 that extend telescopically around the handle so that the dirt cup holder 16 may telescopically move upwardly and downwardly along the handle 12 as the handle is pivoted relative to the cleaner main body as is seen in FIGS. 1 and 2 and as the bellows 14 expands and contracts with this movement.

The tubular portion 18 may, in plan view, define a bore of oblong shape 20 with curved portions intermediate a pair of long legs 22, 22 and with slightly curved short legs 24 joining them. With this arrangement, then, either a properly dimensioned rectangular handle 12' or the round handle 12, can be utilized with the dirt cup configuration.

The dirt cup support 16 at its upper end 26 includes a hooped portion 28 that extends in oblong manner around the upper periphery of the dirt cup support 16. The hooped portion 28 includes a horizontal upper flange lip 30 that extends generally around the hooped portion 28 to provide a seating means for a structure yet to be described. A series of molded hook receiving loops 32, 34, 36, 37, 38 and 39 extend upwardly from bottom portions of the hooped portion 28 with these hook receiving loops providing an engaging means for a filter bag expander 40. The filter bag expander 40 is utilized to connect a pervious filter bag 42 such as cloth or the like to the top of the dirt cup support 16.

The cloth bag 42, at its bottom, is doubled over and sewn to a reinforcing ring 46 that forms a hoop at its bottom side to provide a reinforcement for it and a thickening of the bottom portions of the filter bag 42. This ring and the filter bag 42 at its lower extremities are compressingly captured within the hooped portion 28 of dirt cup support 16 by being disposed between it and the filter bag expander 40 which includes a series of hooks (6 present) such as the hooks 45, 47 and 48 which engage behind the loops 39, 38, 37, respectively, of the dirt cup support 16. Thus, placement of the filter bag expander 40 and filter bag 42 including its ring 46 within the hooped portion 28 of dirt cup support 16 provides a secure assembly since the hooks (e.g. 45, 47 and 48) catch behind and beneath the loops 32, 34, 36, 37 and 39. An upper radially extending flange 49 on the filter bag expander 40 extends around its periphery and radially outwardly to aid in trapping the bag 42 between expander 40 and hooped portion 28.

The filter bag 42 extends upwardly from upper reaches of the dirt cup support 16 so as to engage with the hanging arrangement 50 which comprises a hook 52 attached to the handle 12 and a spring 54 attached thereto, with a hook portion 56 of spring 54 engaging with the hook 52. The spring 54, in turn, includes a second hook portion 58 which engages in an aperture 60 in a conventional bag hanger 62, with the upper portions of the bag being accordian folded as is conventional in the art to be accommodated by the hanger 62. The bag, then, extends from a resilient hanging arrangement 50 to the dirt cup support 16 at its upper reaches to provide a portion of the "take up", the remainder of the "take up" being accorded entirely by the bellows 14 and the telescoping movement of the dirt cup support 16 along the handle 12. The bag can be disassembled from the hanging arrangement 50 and shaken to loosen caked dirt so that it is deposited in the dirt cup (to be described).

Disposed within the dirt cup support 16 is an upper fill tube 64 that extends from the bellows 14, the bellows being resiliently and telescopically sealed over the bottom of the dirt tube 64, upwardly so as to communicate with the filter bag 42. The upper fill tube 64 extends tightly through an integral walled portion 66 of dirt cup support 16 at the upper end of the dirt cup support adjacent hooped portion 28, with both the upper fill tube 64 and the wall 66 being generally oblong in plan view. Flashing 67 may be left on walled portion 66 to aid tightness. This provides a sufficient cross sectional area for the flow of air without necessitating an extremely deep configuration for the dirt cup and dirt cup support arrangement.

A pair of separated plate-like members 68 and 69 extends downwardly from rearward portions of the hooped portion 28 of dirt cup support 16 to provide a support for the upper fill tube 64 at its lower reaches. These plates include at their bottoms rivets 72 and 74 which also pass into ribs, only one rib 76 being shown, molded in the upper fill tube 64. This provides a wider base for the mounting of this tube at its lower reaches and, therefore, greater stability.

At its bottom, the upper fill tube 64 is mounted with a bellows 14 by means of a flange 78 of oval configuration on the upper fill tube 64 which mounts in a corrugation 79 of the bellows 14.

A dirt cup 80 is mounted with the dirt cup support 16 in the following manner. Hooped portion 28 of dirt cup support 16 includes a U-shaped flange 82 at its bottommost periphery, with the dirt cup 80 being oblong in cross section to conform to the hooped portion 28 and also to limit the depth of the total configuration so the same does not obstruct against the user while operating the cleaner 10. Upper portion 84 of the dirt cup 80 sits in the U-shaped channel formed in the hooped portion 28 by flange 82 substantially in a sealing manner by abutting against a seal 85 extending therearound to prevent the loss of entrained dirt out of the dirt cup 80. A series of four ribs, two on each side of the dirt cup, such as ribs 87 and 89 lie on opposite sides of the latches (to be described) so that the latches are nested between their respective pair of ribs.

The dirt cup 80 is partially transparent and extends below the hooped portion 28 to be latched to the hooped shaped portion 28 by a pair of latches 86,86 disposed on opposite sides of the cleaner 10. Latch 86 is preferably plastic and somewhat resilient in nature and includes at its bottom portion a latch nose 88 and a finger portion 90. A curved protrusion 92 on the bottom of the dirt cup 80 provides a means for latching latch nose 88 thereover and in the process straightening and stretching the latch 86 so the same lies flush against the dirt cup 80. A recess 94, about the width of latch 86, is provided in each side of the dirt cup for functioning of the latch.

The latch 86, at its top, is connected to the hooped portion 28 by means of a U-shaped bend 96 providing an inner leg 98 that terminates in an inwardly extending right angle leg 100. A portion of the U-shaped bend 96 and the legs 98 and 100 are captured between the filter bag expander 40, filter bag 42 and the hooped portion 28.

Figure 5:
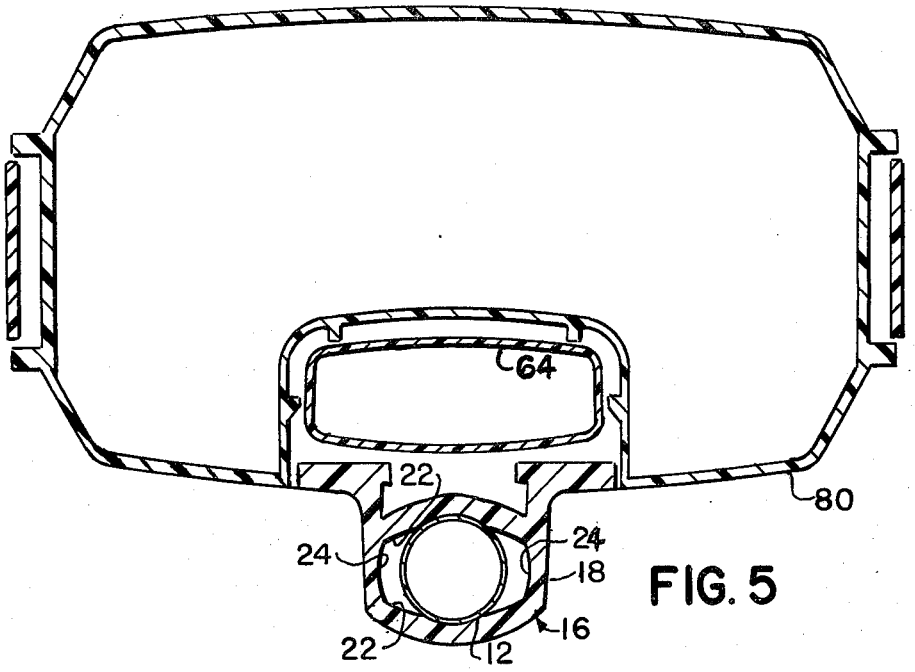
FIG. 5 is a cross sectional plan view taken substantially on line 5—5 of FIG. 4.
Figure 9:
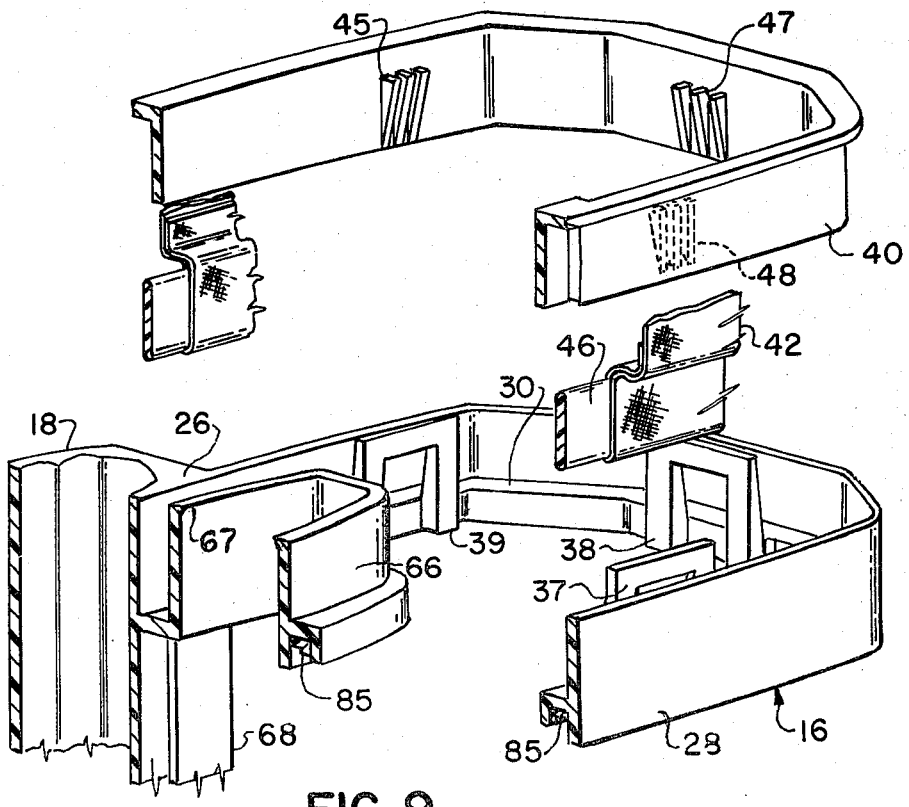
FIG. 9 is a partial perspective exploded view of the juncture of the dirt cup holder, bag and bag expander.
Figure 8:
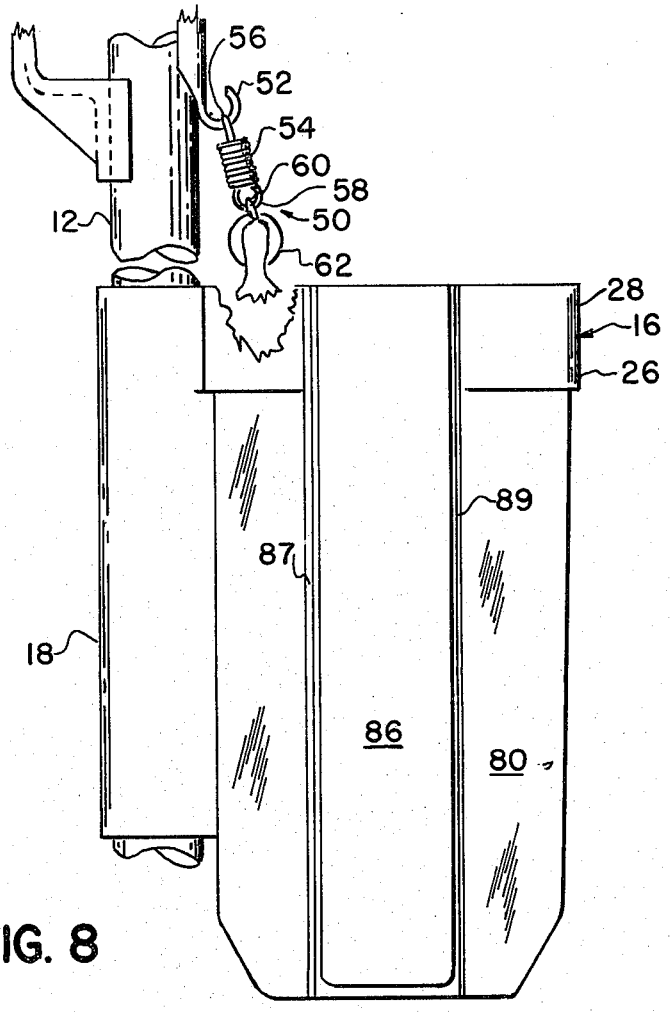
FIG. 8 is an elevational fragmentary side view of the cleaner showing the dirt cup, dirt cup holder and adjacent structure.
Figure 7:
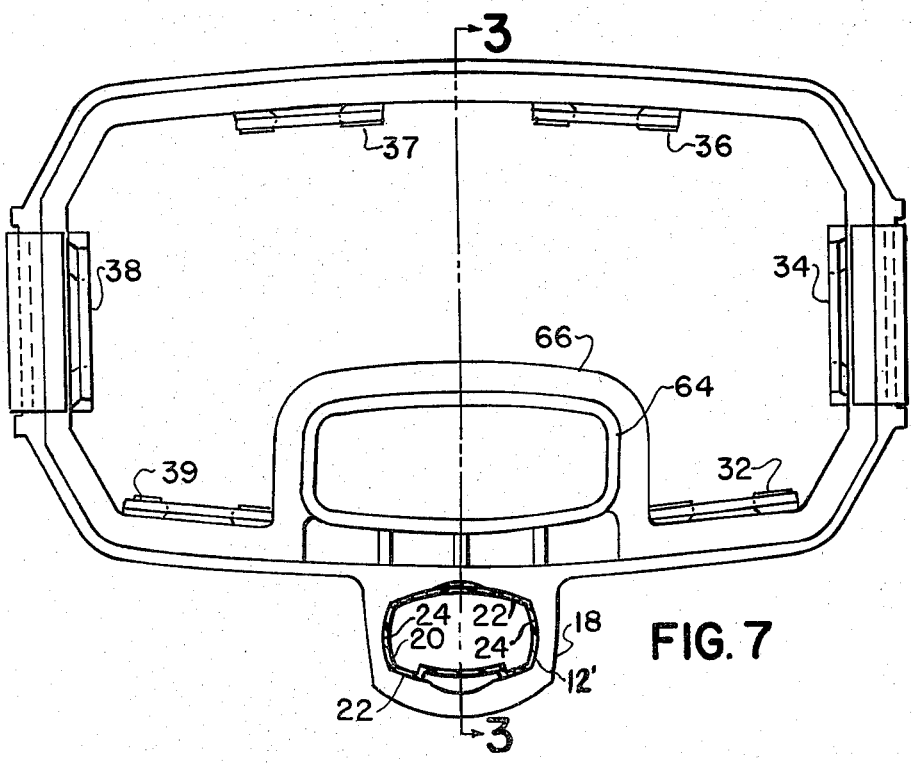
FIG. 7 is a top plan view of the dirt cup holder and dirt tube.

In order to provide additional volume for the dirt cup 80 the same may be seen for FIG. 5 to substantially envelop the opposite sides of the upper fill tube 64 as it extends downwardly from the hooped portion 28.

The operation of the invention can now be understood quite easily. Suction air is generated in a main body 13 of cleaner 10 by its motor fan unit (not shown) and dirt entrained with air then moves upwardly through the bellows 14 into the upper fill tube 64 to be discharged above the dirt cup 80 into the filter bag 42 where air escapes through it because of its pervious nature. The dirt entrained with the original air after entering the bag 42, generally falls down into the dirt cup 80 for accumulation and eventual removal by the user by removal of the dirt cup 80. To accomplish this, latches 86, 86 of the dirt cup 80 are released and the dirt cup 80 is then moved to a waste basket or garbage can or the like and accumulated dirt contained in it is dumped so that the dirt cup 80 can then be utilized again in an empty condition. The dirt cup 80 is remounted to the dirt cup support 16 and the latches 86, 86 reactivated to maintain it in this position and the cleaner 10 is then again ready for operation.

Since the dirt cup 80 and the dirt cup support 16 are attached to the bellows 14 through the rigid upper fill tube 64, movement in a pivoting relation of the handle 12 requires movement of the bellows 14 in an expanding and contracting manner. At the same time, some of the relative travel between the handle 12 and the dirt cup support 16 is taken up by movement of the dirt cup 16 as it slides along handle 12 by means of its telescoping portion 18. This, to a degree, limits the amount of stress placed on the bellows 14 and insures a longer life for it while, at the same time providing a smooth operation of the dirt cup holder 16 relative to the handle 12 as it pivots.

From the foregoing description it should appear clear that a dirt cup arrangement has been provided which insures easy operation of the cleaner on which it is mounted and that the dirt cup configuration provides a cooperative structural arrangement having many advantages. It should also be clear that many modifications could be made to it which would still fall within the purview of its description.

What is claimed is:

1. In an upright vacuum cleaner having a handle extending from a main body portion of said cleaner, a fill tube in confluent communication with a dirt collecting bag and a dirt cup holder from which a dirt cup depends, the improvement including: a lateral extent on said dirt cup holder and a tubular portion extending downwardly from said lateral extent, said lateral extent surrounding said handle and said tubular portion extending telescopically over it so that said dirt cup holder can move freely up and down said handle, said dirt collecting bag having lower reaches adjacent to and attached to said dirt cup holder, said handle being pivoted to said main body portion of said cleaner, and said dirt cup holder telescopically moving along said handle as said handle pivots relative to said main body portion.

2. The cleaner set forth in claim 1 wherein:

a flexible bellows-like element is attached to and extends from said main body portion and is connected to said fill tube, said fill tube being attached to said dirt cup holder whereby extension and compression of said bellow-like element during pivoting of said handle moves said dirt cup holder telescopically along said handle relieving strains imposed on said bellows-like element.

3. The cleaner of either claims 1 or 2 wherein: a latch arrangement is additionally provided said latch arrangement including at least one resilient latching element, said resilient latching element extending downwardly along said dirt cup from said dirt cup holder and including a nose portion at its lower end that engages a bottom side of said dirt cup to captivate said dirt cup with said dirt cup holder, said resilient latching element being deformable intermediate its ends for release of said dirt cup.

4. The cleaner as set out in claim 1 wherein: said tubular portion of said dirt cup holder includes an oblong bore with curved portions, in cross section, for said telescopic engagement of said tubular portion over said handle to thereby enable the use of one of a round and square handle to mount said dirt cup holder.

5. The cleaner set out in claim 1 wherein:

said dirt cup holder includes at least one downwardly disposed plate-like member extending from said lateral extent, said plate-like member being attached at its bottom to said fill tube.

6. In an upright vacuum cleaner having a handle extending from a main body portion of said cleaner, a fill tube in confluent communication with a dirt collecting bag and a dirt cup holder from which a dirt cup depends, the improvement including: a lateral extent on said dirt cup holder and a tubular portion extending downwardly from said lateral extent, said lateral extent surrounding said handle and said tubular portion extending telescopically over it so that said dirt cup holder can move freely up and down said handle, said dirt collecting bag having lower reaches adjacent to and attached to said dirt cup holder, said dirt collecting bag including at its lower reaches a hooped reinforcing member, a bag expander, an upper portion of said dirt cup holder and said bag expander having complementary hook and a loop portions and said hooped reinforcing member being caught between said bag expander and said upper portion of said dirt cup holder.

7. In an upright vacuum cleaner having a handle extending from a main body portion of said cleaner, a fill tube in confluent communication with a dirt collecting bag and a dirt cup holder from which a dirt cup depends, the improvement including: a lateral extent on said dirt cup holder and a tubular portion extending downwardly from said lateral extent, said lateral extent surrounding said handle and said tubular portion extending telescopically over it so that said dirt cup holder can move freely up and down said handle, said dirt collecting bag having lower reaches adjacent to and attached to said dirt cup holder, latches attached to said dirt cup holder and extending downwardly along said dirt cup, said latches engaging said dirt cup to hold said dirt cup to said dirt cup holder a bag expander disposed within said dirt cup holder so as to capture said dirt collecting bag between said dirt cup holder and said expander, and said latches, at their upper ends, being received compressively between said dirt cup holder and said bag expander.

* * * * *